US010566743B2

(12) United States Patent
Zhao et al.

(10) Patent No.: US 10,566,743 B2
(45) Date of Patent: Feb. 18, 2020

(54) ELECTRICAL CONNECTOR HAVING A MIDDLE SHIELDING PLATE AND AN OUTER SHIELDING SHELL WITH GROUNDING LEGS HELD IN PLACE BY THE SHIELDING PLATE

(71) Applicants: FUYU ELECTRONICAL TECHNOLOGY (HUAIAN) CO., LTD., Huai'an (CN); FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignees: FUYU ELECTRONICAL TECHNOLOGY (HUAIAN) CO., Huai'an (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/191,410

(22) Filed: Nov. 14, 2018

(65) Prior Publication Data

US 2019/0148890 A1 May 16, 2019

(30) Foreign Application Priority Data

Nov. 15, 2017 (CN) ..... 2017 2 1528449 U

(51) Int. Cl.

| | |
|---|---|
| ***H01R 13/6594*** | (2011.01) |
| *H01R 13/6585* | (2011.01) |
| *H01R 12/72* | (2011.01) |
| *H01R 107/00* | (2006.01) |
| *H01R 24/60* | (2011.01) |

(52) U.S. Cl.
CPC ..... *H01R 13/6594* (2013.01); *H01R 12/725* (2013.01); *H01R 13/6585* (2013.01); *H01R 24/60* (2013.01); *H01R 2107/00* (2013.01)

(58) Field of Classification Search
CPC ..... H01R 13/6594; H01R 13/6585; H01R 12/725
USPC ..... 439/83
See application file for complete search history.

(56) References Cited

U.S. PATENT DOCUMENTS

| | | | | |
|---|---|---|---|---|
| 9,843,148 | B2 * | 12/2017 | Little | H01R 24/60 |
| 9,893,473 | B2 * | 2/2018 | Kong | H01R 13/6594 |
| 9,960,552 | B2 * | 5/2018 | Tsai | H01R 24/64 |
| 9,985,393 | B2 * | 5/2018 | Zhao | H01R 12/58 |
| 10,079,456 | B2 * | 9/2018 | Chen | H01R 13/6461 |

(Continued)

FOREIGN PATENT DOCUMENTS

| | | |
|---|---|---|
| CN | 204558804 | 8/2015 |
| CN | 107546541 | 1/2018 |

*Primary Examiner* — Alexander Gilman
(74) *Attorney, Agent, or Firm* — Wei Te Chung; Ming Chieh Chang

(57) ABSTRACT

An electrical connector includes: an insulative housing having a base and a tongue; an upper and a lower rows of contacts secured to the insulative housing and exposed, respectively, to an upper and a lower faces of the tongue; a shielding plate arranged between the upper row of contacts and the lower row of contacts; and a shielding shell enclosing the insulative housing, wherein the shielding plate has a pair of side hooks exposed to an outside of the insulative housing, and the shielding shell has a pair of grounding legs kept in position by the pair of side hooks of the shielding plate.

19 Claims, 12 Drawing Sheets

(56) References Cited

U.S. PATENT DOCUMENTS

| | | | | |
|---|---|---|---|---|
| 10,164,379 | B2 * | 12/2018 | Duan | H01R 13/6585 |
| 10,164,791 | B2 * | 12/2018 | Wang | H01R 12/7023 |
| 10,211,563 | B2 * | 2/2019 | Zhao | H01R 12/724 |
| 10,218,134 | B2 * | 2/2019 | Tsai | H01R 13/6585 |
| 10,236,632 | B2 * | 3/2019 | Zhang | H01R 13/50 |
| 10,263,372 | B2 * | 4/2019 | Yao | H01R 13/6595 |
| 10,297,943 | B2 * | 5/2019 | Hou | B29C 45/00 |
| 10,312,635 | B2 * | 6/2019 | Zhao | H01R 43/16 |

* cited by examiner

ELECTRICAL CONNECTOR HAVING A MIDDLE SHIELDING PLATE AND AN OUTER SHIELDING SHELL WITH GROUNDING LEGS HELD IN PLACE BY THE SHIELDING PLATE

BACKGROUND OF THE INVENTION

1. Field of the Invention

The present invention relates to an electrical connector including an insulative housing retaining two rows of contacts and a middle grounding plate, and a shielding shell enclosing the insulative housing, wherein the shielding shell has a pair of soldering legs upwardly abutting the grounding plate reliably.

2. Description of Related Arts

It is known for an electrical connector to comprise an insulative housing retaining an upper and a lower rows of contacts and a middle shielding plate arranged between the upper row of contacts and the lower row of contacts and a shielding shell enclosing the insulative housing, wherein the shielding shell has a pair of grounding legs secured in position by the insulative housing.

SUMMARY OF THE INVENTION

An electrical connector comprises: an insulative housing having a base and a tongue; an upper and a lower rows of contacts secured to the insulative housing and exposed, respectively, to an upper and a lower faces of the tongue; a shielding plate arranged between the upper row of contacts and the lower row of contacts; and a shielding shell enclosing the insulative housing, wherein the shielding plate has a pair of side hooks exposed to an outside of the insulative housing, and the shielding shell has a pair of grounding legs kept in position by the pair of side hooks of the shielding plate.

DETAILED DESCRIPTION OF THE PREFERRED EMBODIMENT

Figure 1:
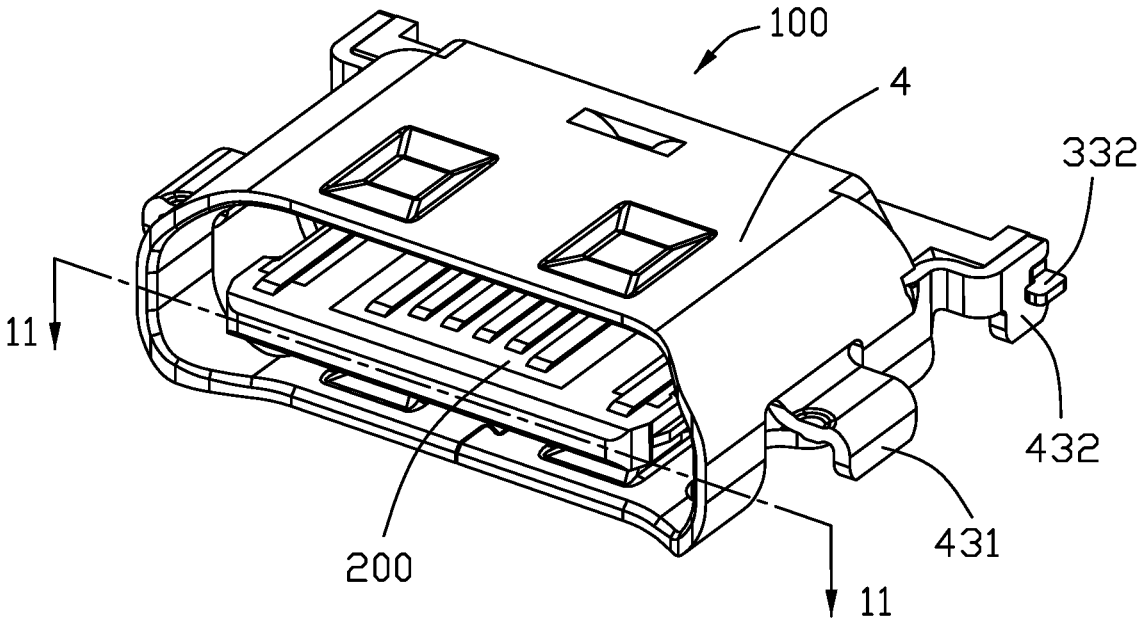
FIG. 1 is a front and top perspective view of an electrical connector in accordance with the present invention.

Referring to FIGS. 1-10, an electrical connector 100 comprises an insulative housing 1 having a base 11 and a tongue 12, an upper and a lower rows of contacts 2 secured to the insulative housing 1 and exposed, respectively, to an upper and a lower faces of the tongue 12, a shielding plate 3 arranged between the upper row of contacts 21 and the lower row of contacts 22, and a shielding shell 4 enclosing the insulative housing 1. The insulative housing 1, the contacts 2, and the shielding plate 3 constitute a contact module.

Referring specifically to FIGS. 3-10, the base 11 has a base portion 111 and a rear mounting portion 112. The base portion 111 has at an upper thereof a first recess 1111 and a pair of notches 1112 and at a lower thereof a pair of second recesses 1113 and a third recess 1114. The mounting portion 112 is elongate and has a lateral dimension greater than that of the base portion 111. The base portion 111 has a pair of lateral protrusions 1121. The insulative housing 1 is constructed of a first insulator 13 and a second insulator 14. The first insulator 13 contains the base portion 111 and a first tongue portion 131. The second insulator 14 is insert molded with the first insulator 13 to form, together with the first tongue portion 131, the complete tongue 12.

Referring specifically to FIGS. 7-10, each of the upper and lower contacts 21 and 22 has a contacting portion 23, a soldering portion 25, and a securing portion 24 therebetween. The contacting portions 23 of the contacts 21 and 22 are reversely-symmetrically arranged, as is well known in this art.

The shielding plate 3 is constructed of two pieces each having a main portion 31, a soldering leg 32, and a generally U-shaped side hook 33 exposed to an outside of the insulative housing 1. The soldering legs 32 is located inwardly of the side hook 33. The side hook 33 has an inner arm 331, an outer arm 332, and an engaging portion 333 therebetween. Notably, each piece has a locking edge (not labeled) around a front portion exposed upon a side edge of the tongue 12 for locking a mating plug connector (not shown).

The two rows of contacts 2 and the shielding plate 3 are insert molded with the first insulator 13 and then the second insulator 14 is molded to the first tongue portion 131. The soldering legs 32 are located at two opposite outer sides of the soldering portions 25 and arranged in a line. The engaging portion 333 is exposed and registered under the protrusion 1121 of the mounting portion 112.

Figure 3:
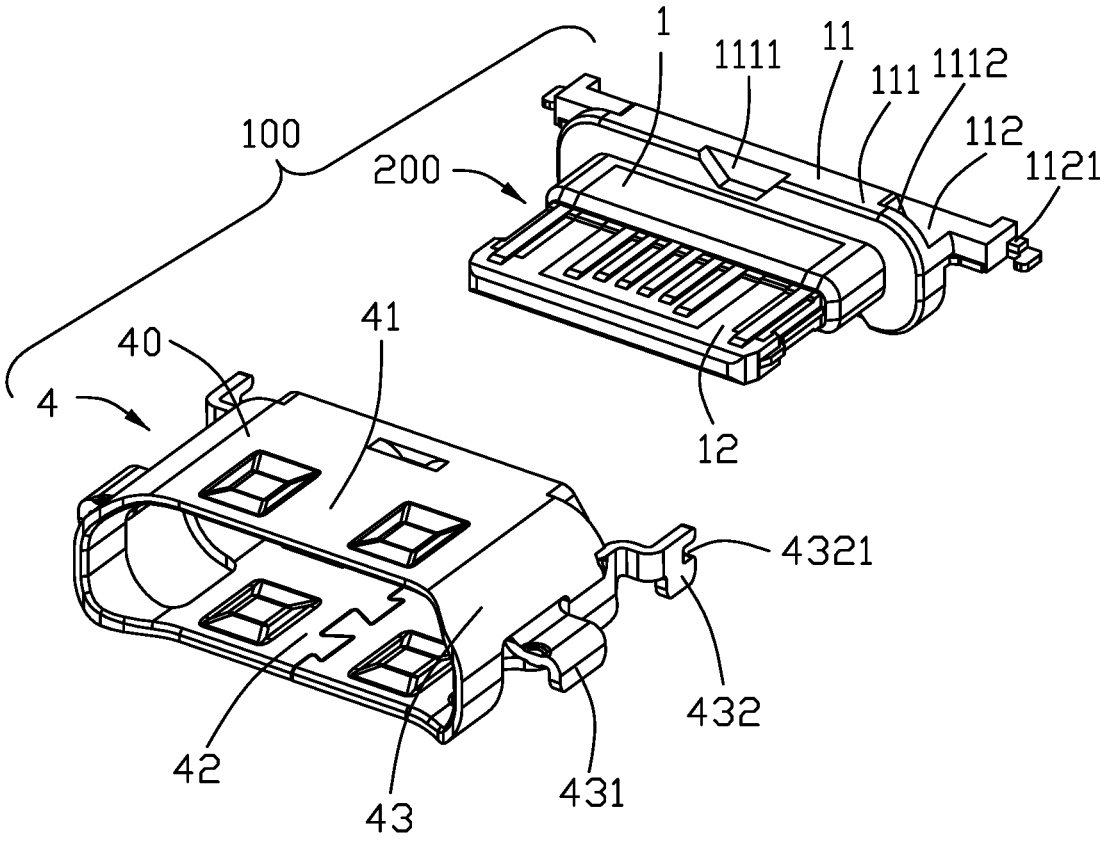
FIG. 3 is an exploded view of the electrical connector.
Figure 4:
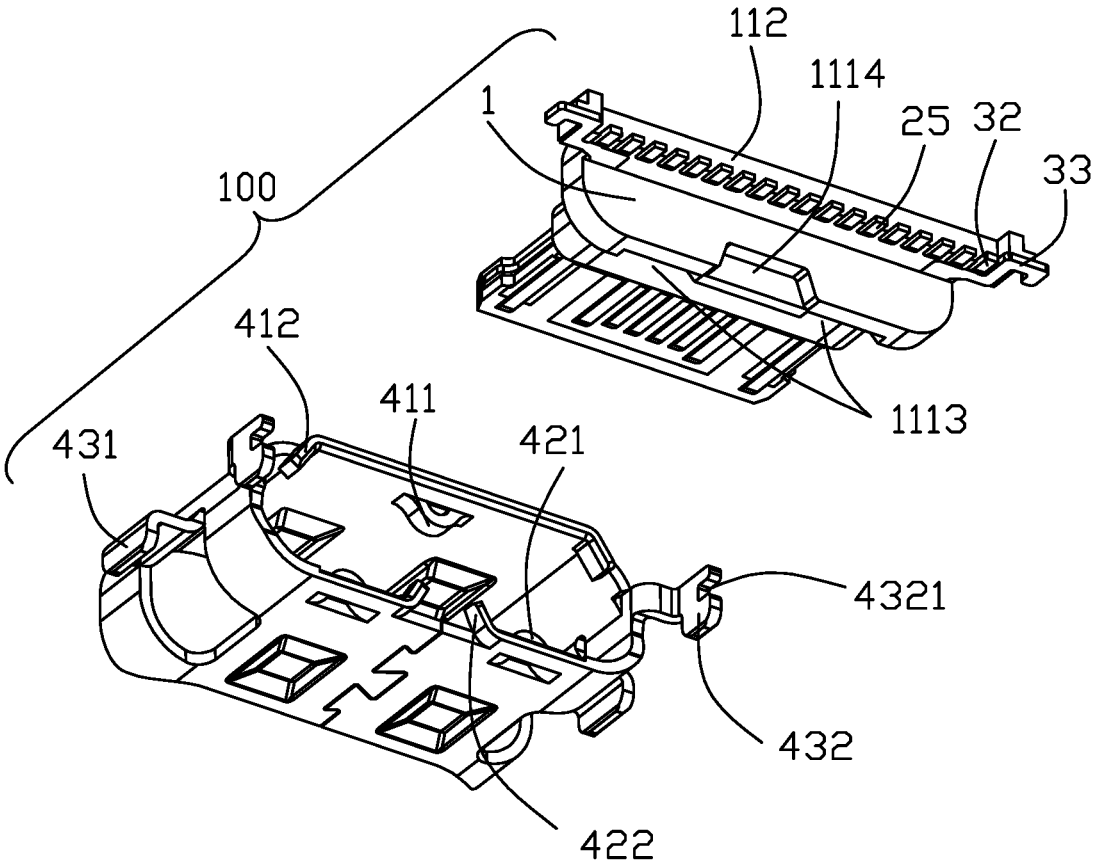
FIG. 4 is a view similar to FIG. 3 but from another perspective.
Figure 5:
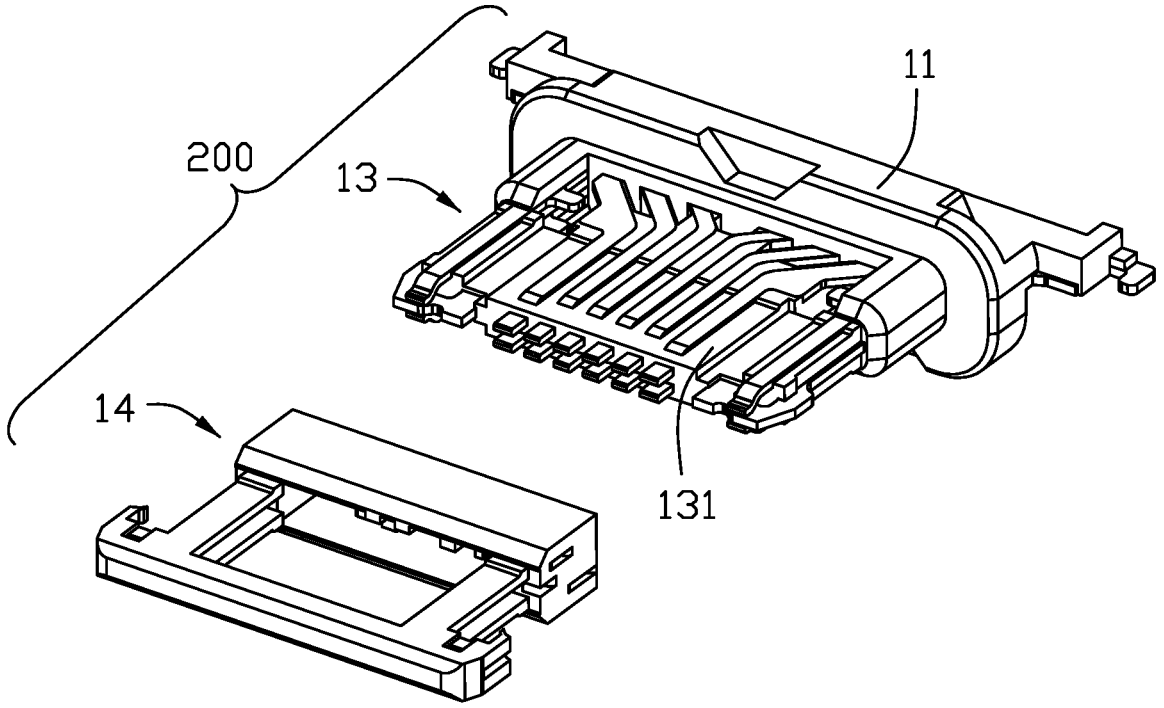
FIG. 5 is a further exploded view of a terminal module of the electrical connector in FIG. 3.
Figure 6:
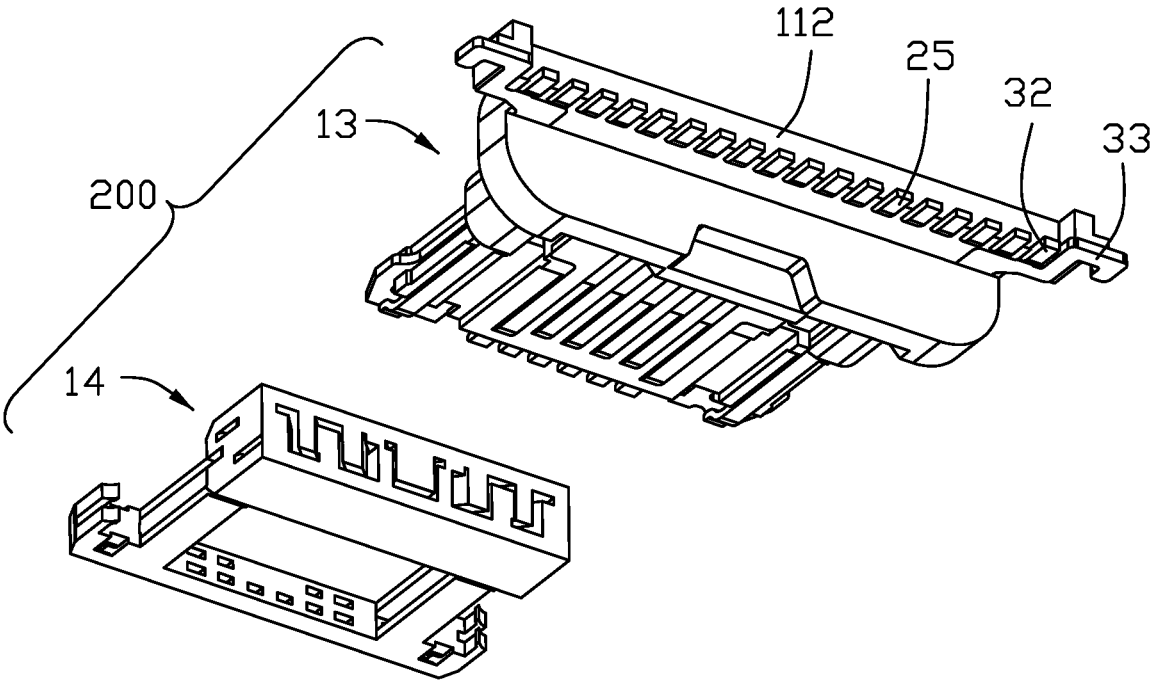
FIG. 6 is a view similar to FIG. 5 but from another perspective.
Figure 7:
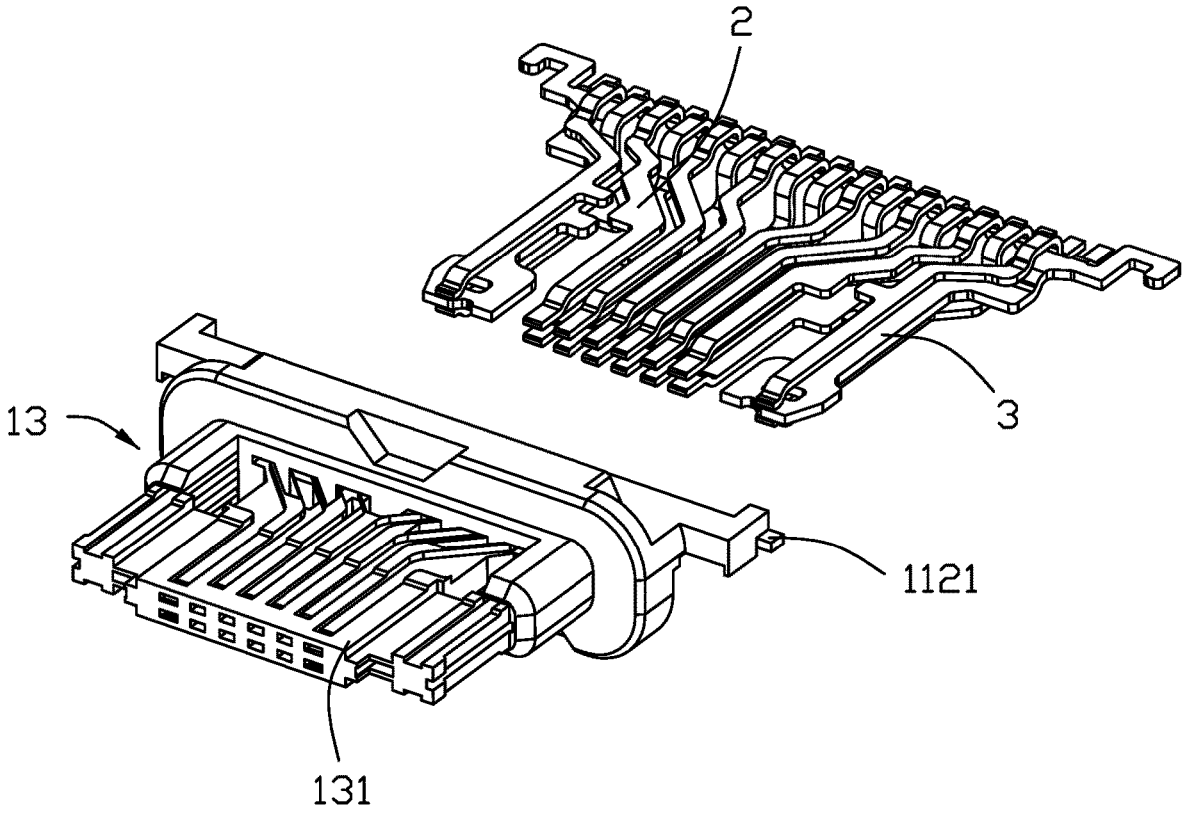
FIG. 7 is a further exploded view of the terminal module in FIG. 5 omitting an insulator thereof.
Figure 8:
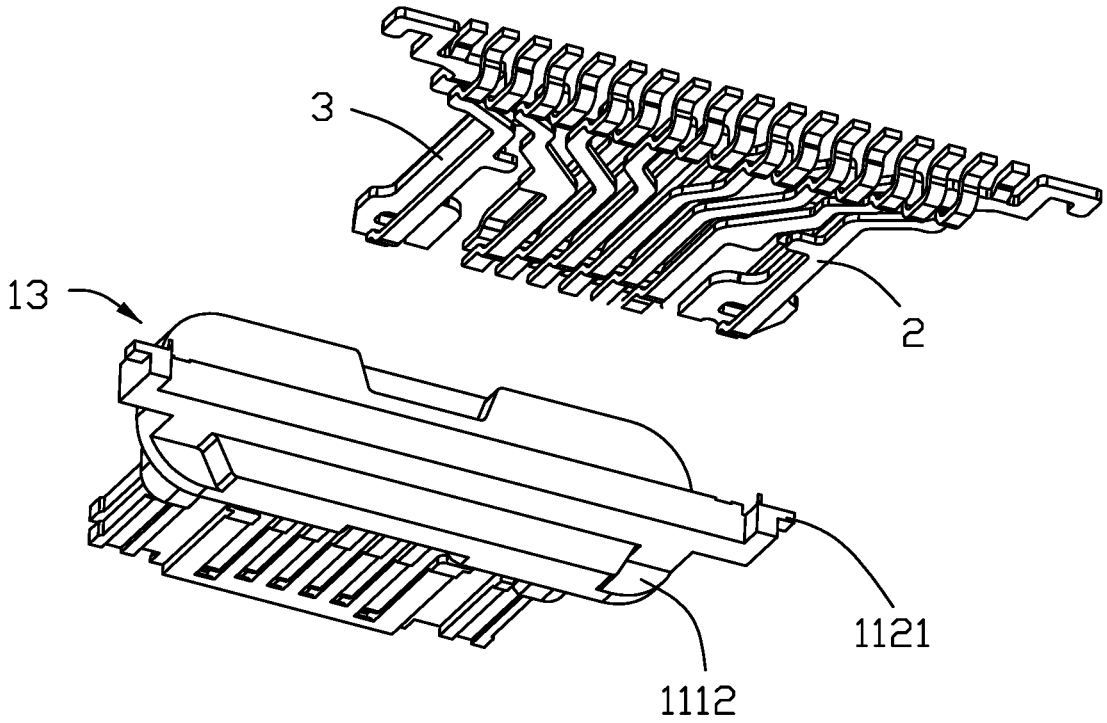
FIG. 8 is a view similar to FIG. 7 but from another perspective.
Figure 9:
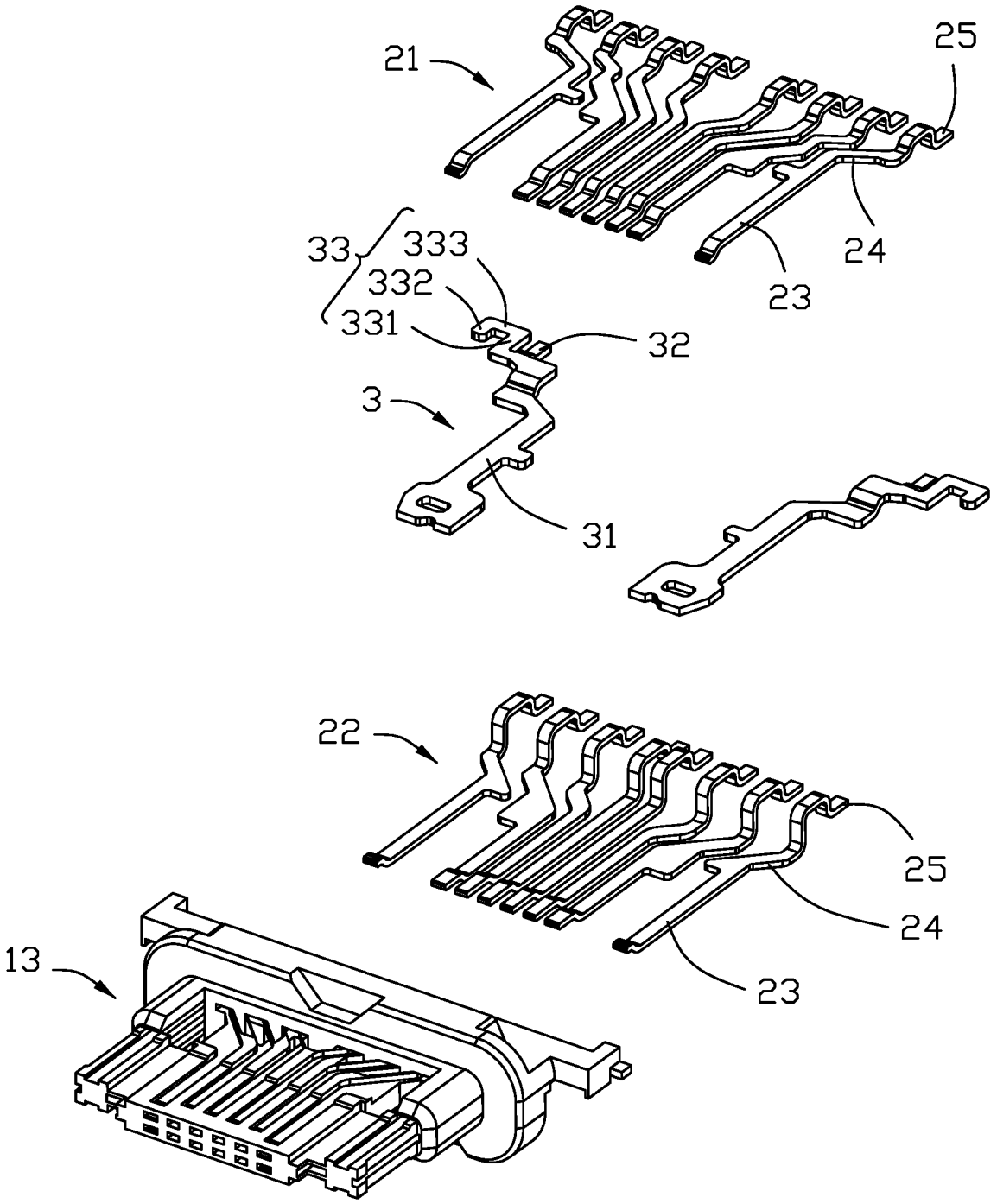
FIG. 9 is a further exploded view of FIG. 7.
Figure 10:
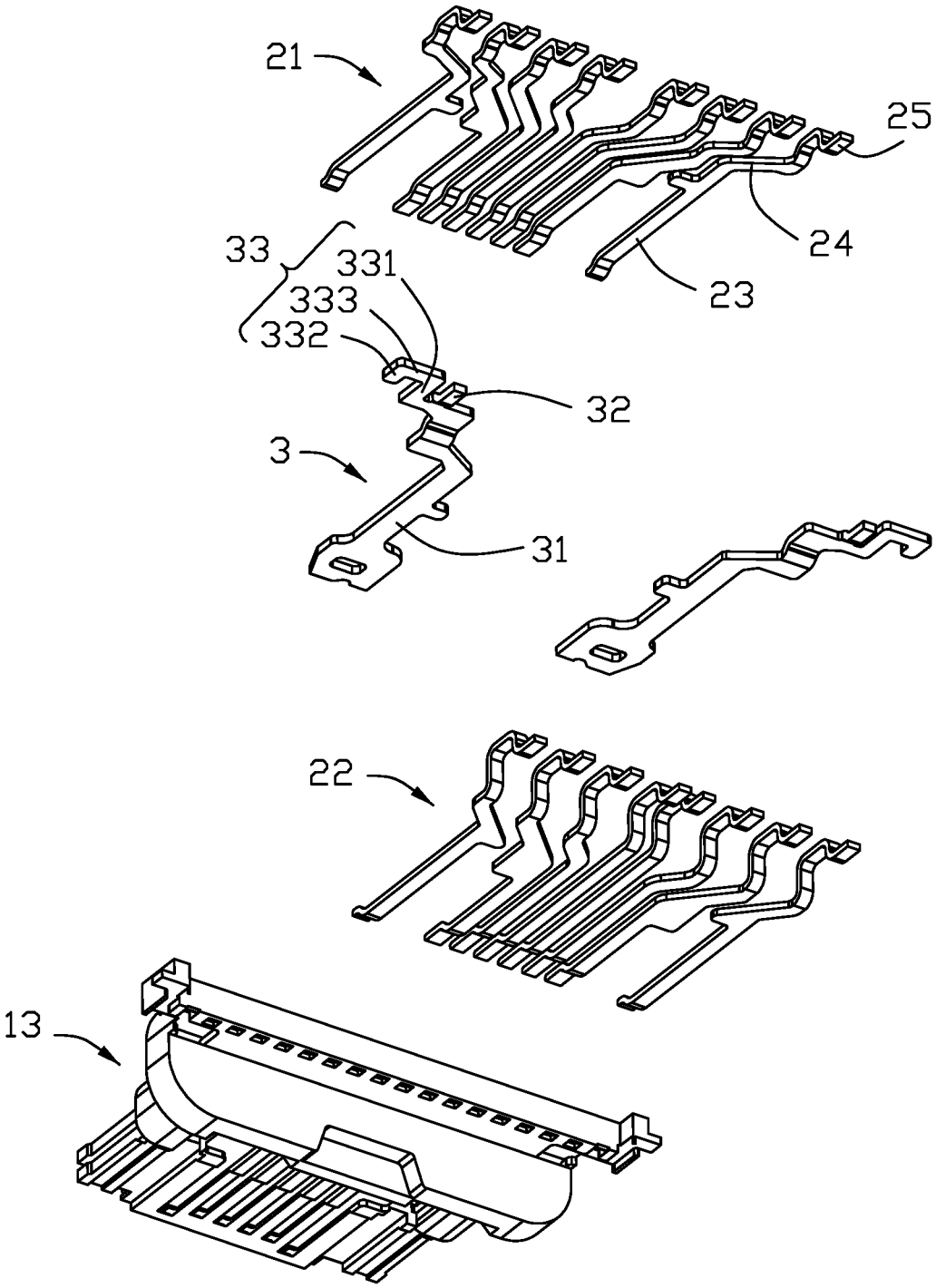
FIG. 10 is a further exploded view of FIG. 8.

Referring specifically to FIGS. 3 and 4, the shielding shell 4 has an upper wall 41, a lower wall 42, and a pair of side walls 43, together bordering a tubular portion 40. The upper wall 41 has a first tearing portion 411 and a pair of bent portions 412. The lower wall 42 has a pair of second tearing portions 421 and a pair of bent portions 422. Each side wall 43 has a fixing leg 431 and a grounding leg 432. The grounding leg 432 has a notch 4321.

Figure 2:
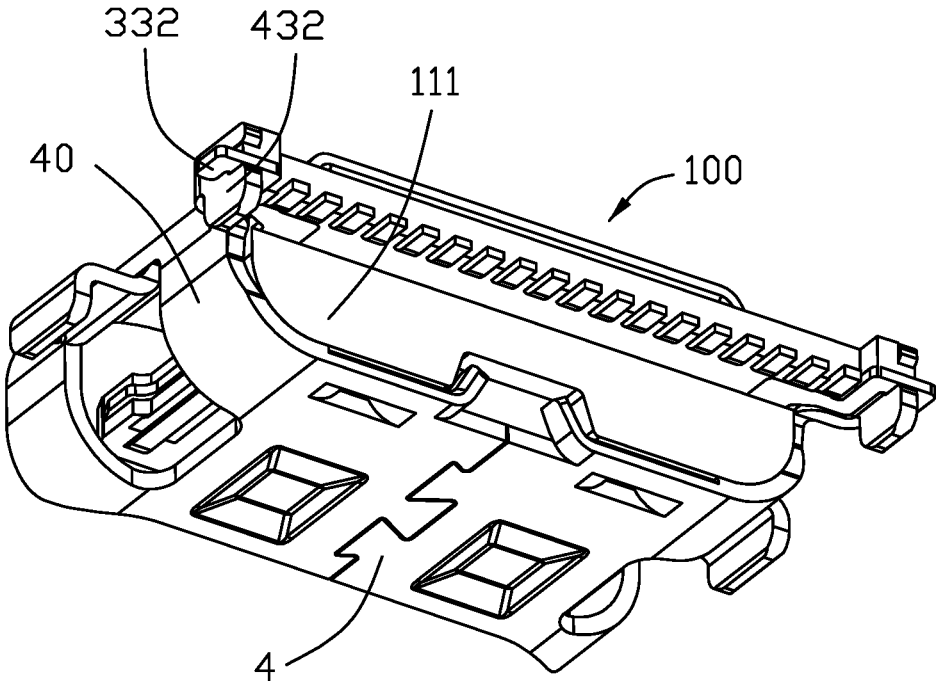
FIG. 2 is a rear and bottom perspective view of the electrical connector.
Figure 11:
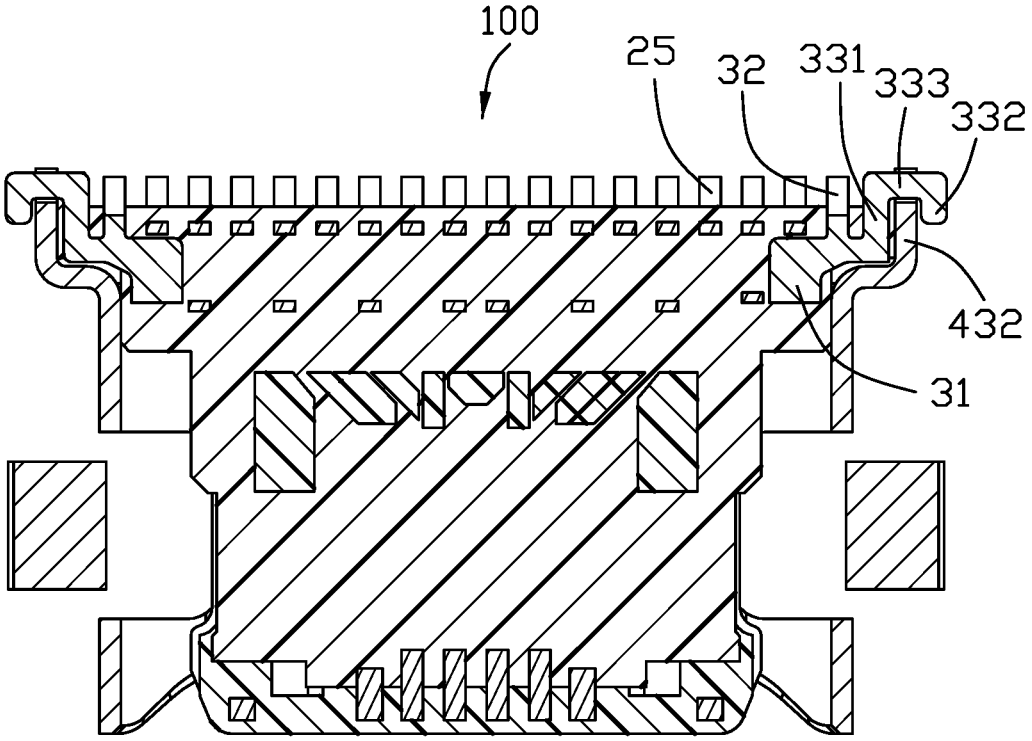
FIG. 11 is a cross-sectional view of the electrical connector taken along line A-A in FIG. 1.

Referring specifically to FIGS. 1-2 and 11, the shielding shell 4 encloses the contact module, and the tubular portion 40 encloses the base portion 111. The first tearing portion 411 engages the first recess 1111, the pair of second tearing portions 421 engage the pair of second recesses 1113, the pair of second tearing portions 421 engage the pair of notches 1112, and the pair of bent portions 422 engage the third recess 1114. The grounding legs 432 bear against two opposite sides of the mounting portion 112. The side hook 33 latches to the grounding leg 432 to limit a laterally outward movement of the grounding leg 432. In the embodiment shown, the engaging portion 333 of the side hook 33 together with the protrusion 1121 of the mounting portion 112 is received in the notch 4321 of the grounding leg 432, and the outer arm 332 of the side hook 33 is located at an outer face of the grounding leg 432 to prevent an outward movement of the grounding leg 432 relative to the side hook 33.

Figure 1A:
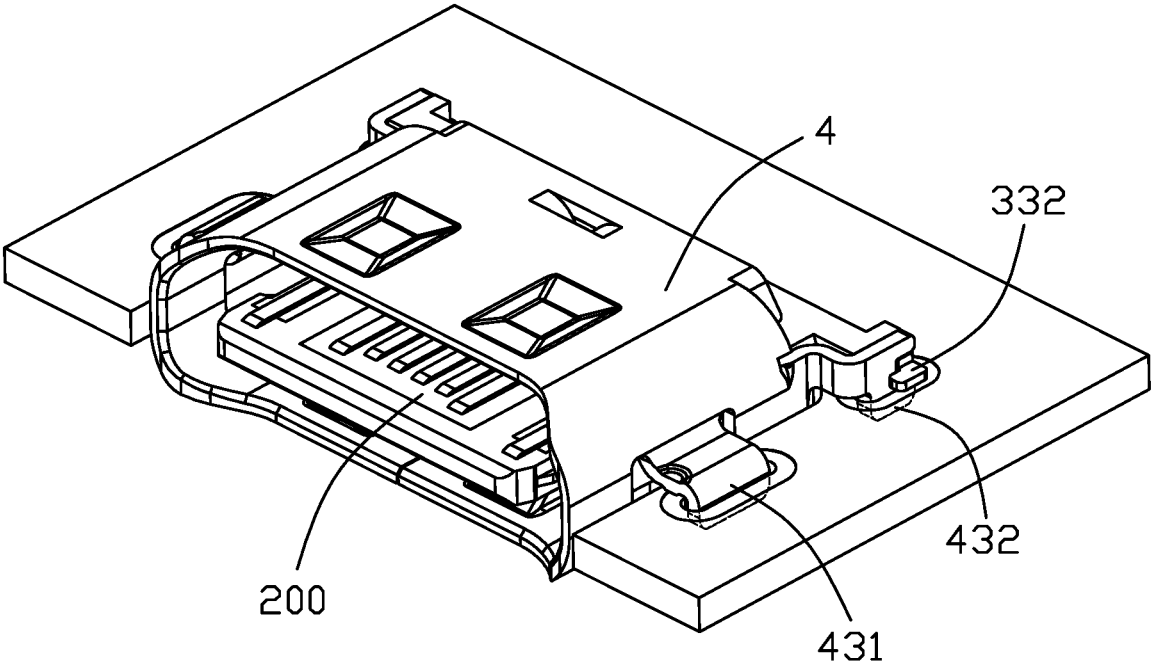
FIG. 1(A) is a front and top perspective view of the electrical connector mounted upon a printed circuit board.

Compared to prior art, use of the shielding plate 3 to stably keep the grounding legs 432 of the shielding shell 4 from displacement ensures a subsequent positioning and soldering operation of the grounding legs 432 within a through hole of the printed circuit board (not labeled) (FIG. 1(A)) may be performed reliably. In this embodiment, the horizontal section of the fixing leg 431 is seated upon the printed circuit board to support the front portion of the connector while the horizontal section of the grounding leg 432 is spaced from the printed circuit board because the soldering portions 25 are mounted upon the printed circuit board to support the rear portion of the connector instead. In this embodiment, both the fixing leg 431 and the grounding leg 432 are inserted into and fixed within the corresponding holes of the printed circuit board wherein the front fixing leg 431 is suspended without the support by the housing 1 while has the support in the vertical direction by the protrusion 1121 of the mounting portion 112 of the housing 1 and by the side hook 33 of the shielding plate 3. Also, the grounding leg 432 is sandwiched between the outer arm 332 of the side hook 33 and the side face of the mounting portion 112 of the housing 1 in the transverse direction perpendicular to the vertical direction and the front-to-back direction. Notably, both the vertical section of the fixing leg 431 or the grounding leg 432, which is received within the corresponding through hole of the printed circuit board, is outwardly spaced/offset from the side wall of the shielding shell 4 wherein the narrow vertical connection section (not labeled) of the grounding leg 432 tends to be deflected, compared with the horizontal connection section of the fixing leg 431, so the side hook 33 of the shielding plate 3 is requisitely engaged with the grounding leg 432 for securing consideration. Understandably, both the side hook 33 and the grounding leg 432 have the corresponding notch structures so as to be interengaged with each other in a cross manner for restraining movement of the grounding leg 432 in both the vertical direction and the transverse direction. In other words, in this embodiment the vertical section of the grounding leg 432 is located in a vertical plane while the side hook 332 is located in a horizontal plane intersecting with the vertical plane in a perpendicular manner.

What is claimed is:

1. An electrical connector comprising:

an insulative housing having a base and a tongue;

an upper and a lower rows of contacts secured to the insulative housing and exposed, respectively, to an upper and a lower faces of the tongue;

a shielding plate arranged between the upper row of contacts and the lower row of contacts; and a shielding shell enclosing the insulative housing, wherein the shielding plate has a pair of side hooks exposed to an outside of the insulative housing, the shielding shell has a pair of grounding legs kept in position by the pair of side hooks of the shielding plate, the pair of grounding legs extend rearward from a pair of side walls of the shielding shell, and the shielding plate is constructed of two pieces each having a corresponding one of the pair of side hooks, each hook having an outer arm located at an outer face of a corresponding grounding leg to prevent an outward movement of the grounding leg relative to the hook.

2. The electrical connector as claimed in claim 1, wherein:

each of the pair of grounding legs has a notch; and each of the pair of side hooks has an engaging portion received in the notch.

3. The electrical connector as claimed in claim 2, wherein the base of the insulative housing has a pair of protrusions each received in a corresponding notch.

4. The electrical connector as claimed in claim 1, wherein the shielding plate has a pair of soldering legs located inwardly of the pair of side hooks.

5. An electrical connector comprising:

an insulative housing having a base and a tongue extending forwardly from the base in a front-to-back direction;

an upper and a lower rows of contacts secured to the insulative housing and exposed, respectively, to an upper and a lower faces of the tongue;

a metallic shielding plate arranged between the upper row of contacts and the lower row of contacts in a vertical direction perpendicular to said front-to-back direction; and a metallic shielding shell enclosing the insulative housing, wherein a pair of grounding legs unitarily extend respectively from rear ends of two side walls of the shielding shell rearwardly in the front-to-back direction and outwardly in a transverse direction perpendicular to both the front-to-back direction and the vertical direction, and a pair of side hooks unitarily extend from a rear end of the shielding plate to be interengaged with the pair of corresponding grounding legs, respectively, for restricting outward movement of the corresponding grounding legs in the transverse direction.

6. The electrical connector as claimed in claim 5, wherein the grounding leg is restricted from moving inwardly in the transverse direction by the corresponding side hook.

7. The electrical connector as claimed in claim 5, wherein each of the grounding legs has a notch to receive the corresponding side hook therein so as to restrict the grounding leg from moving in the vertical direction relative to the side hook.

8. The electrical connector as claimed in claim 7, wherein the housing forms at a rear end thereof a mounting portion with two opposite sidewardly extending protrusions, and the notch receives therein both said side hook and the corresponding protrusion in the vertical direction.

9. The electrical connector as claimed in claim 8, wherein the sidewardly extending protrusion downwardly abuts against the corresponding side hook in the vertical direction.

10. The electrical connector as claimed in claim 8, wherein each of the grounding legs is sandwiched between the corresponding side hook and the mounting portion in the transverse direction.

11. The electrical connector as claimed in claim 5, wherein said shielding plate includes two pieces each equipped with the corresponding side hook, and each piece further includes a locking edge exposed upon a corresponding lateral side of the tongue, and a soldering leg located inside of the corresponding side hook in the transverse direction.

12. The electrical connector as claimed in claim 5, wherein the side hook lies in a horizontal plane while the corresponding grounding legs lies in a vertical plane intersected with the horizontal plane in a perpendicular manner.

13. An electrical connector assembly comprising:

a printed circuit board including a pair of holes;

an electrical connector comprising:

an insulative housing having a base and a tongue extending forwardly from the base in a front-to-back direction;

an upper and a lower rows of contacts secured to the insulative housing and exposed, respectively, to an upper and a lower faces of the tongue;

a metallic shielding plate arranged between the upper row of contacts and the lower row of contacts in a vertical direction perpendicular to said front-to-back direction; and a metallic shielding shell enclosing the insulative housing, wherein a pair of grounding legs are received within the corresponding holes of the printed circuit board and unitarily extending respectively from rear ends of two side walls of the shielding shell rearwardly in the front-to-back direction and outwardly in a transverse direction perpendicular to both the front-to-back direction and the vertical direction, and a pair of side hooks unitarily extend from a rear end of the shielding plate to be interengaged with the pair of corresponding grounding legs, respectively, for restricting outward movement of the corresponding grounding legs in the transverse direction.

14. The electrical connector assembly as claimed in claim 13, wherein each of said grounding legs has a narrow curved connection section positioned upon the printed circuit board to connect to the rear end of the corresponding side wall of the shielding shell.

15. The electrical connector assembly as claimed in claim 13, wherein the grounding leg is restricted from moving inwardly in the transverse direction by the corresponding side hook.

16. The electrical connector assembly as claimed in claim 15, wherein each of the grounding legs has a notch to receive the corresponding side hook therein so as to restrict the grounding leg from moving in the vertical direction relative to the side hook.

17. The electrical connector assembly as claimed in claim 16, wherein the housing forms at a rear end thereof a mounting portion with two opposite sidewardly extending protrusions, and the notch receives therein both said side hook and the corresponding protrusion in the vertical direction.

18. The electrical connector assembly as claimed in claim 17, wherein the sidewardly extending protrusion downwardly abuts against the corresponding side hook in the vertical direction.

19. The electrical connector assembly as claimed in claim 17, wherein each of the grounding legs is sandwiched between the corresponding side hook and the mounting portion in the transverse direction.

* * * * *